US005243725A

United States Patent [19]

Fowler

[11] Patent Number: 5,243,725

[45] Date of Patent: Sep. 14, 1993

[54] COMFORTERS

[76] Inventor: Susan Fowler, 10 William St., Rumson, N.J. 07760

[21] Appl. No.: 780,042

[22] Filed: Oct. 21, 1991

[51] Int. Cl.[5] ..... A47G 9/04; A47G 9/00

[52] U.S. Cl. ..... 5/502; 5/501

[58] Field of Search ..... 5/502, 500, 499, 501, 5/485, 426; D6/603

[56] References Cited

U.S. PATENT DOCUMENTS

| | | | |
|---|---|---|---|
| 2,821,723 | 2/1958 | Gluck | 5/501 |
| 3,467,974 | 9/1969 | Deutsch | 5/502 |

FOREIGN PATENT DOCUMENTS

| | | | |
|---|---|---|---|
| 49761 | 1/1935 | Denmark | 5/502 |
| 1017350 | 10/1957 | Fed. Rep. of Germany | 5/502 |
| 20017 | 11/1899 | Switzerland | 5/502 |
| 174969 | 2/1935 | Switzerland | 5/502 |
| 3287 | of 1908 | United Kingdom | 5/502 |

OTHER PUBLICATIONS

"Dowl-Lite" Diagonal Box Model Comforters brochures available from Down Lite International, 106 Northeast Drive, Loveland, Ohio, 45140; designs believed to be 1989 or earlier.

*Primary Examiner*—Alexander Grosz
*Attorney, Agent, or Firm*—Larson & Taylor

[57] ABSTRACT

The comforters of the invention comprise fabrics filled with down or synthetic material. In one embodiment of the invention, intended for winter use, the comforters are stitched diagonally across, between its four opposing corners, and are also diagonally stitched between the midpoints of its adjacent edges, thereby providing 4-large diamond-shaped sections and producing five connecting interstices. In a second embodiment, intended for spring and summer use, the comforters are additionally stitched from one edge to its opposing edge, to intersect the five connecting interstices, thereby dividing the 4-diamond-shaped sections in half. In a third embodiment, intended for summer use, the comforters are further stitched between its remaining two edges, also to intersect the five connecting interstices, and dividing the original diamond-shaped sections in half once again. By lessening the size of the sections thus being filled with less material as one proceeds from winter to summer use in this manner, the degree of "puff" of the comforter can be maintained, as can its luxuriant look.

5 Claims, 2 Drawing Sheets

COMFORTERS

FIELD OF THE INVENTION

This invention relates to comforters in general, and to comforters filled with down or synthetic material, in particular.

BACKGROUND OF THE INVENTION

As is well known and understood, comforters are generally of three types—heavy-weight (intended for winter use), light-weight (intended for summer use), and mid-weight (for use during the spring and fall seasons). As is also well known and understood, the comforters are generally stitched differently depending upon the amount of down or synthetic material utilized—but, tend to take on a "flat" look as more and more squares and other patterns are utilized in sectioning the comforter for summer use as significantly reduced down or synthetic material, is employed to provide the light-weight needed. As is also well known and understood, even for mid-weight or heavy-weight comforters, all comforter designs presently employed tend to slide about, or otherwise move around in, duvet or other covers in which they are oftentimes inserted. The overall result, with both these problems, is that the comforter tends to look somewhat "saggy" and not as "puffy" or luxuriant as it could look.

SUMMARY OF THE INVENTION

As will become clear hereinafter, the comforters of the present invention employ a unique stitching arrangement designed to maintain a luxuriant look of "puff" in the comforter regardless of whether it is of heavy-weight, medium-weight or light-weight construction. As will also be seen, the unique stitching arrangement allows for the attachment of fabric ties, buttons, etc. at defined positions, so as to permit the comforter to be secured with its associated cover, in presenting the same overall look to the comforter—with or without its cover—during all seasons of use.

In particular, the comforters of the invention will be seen to be stitched diagonally across, between its four opposing corners, and also stitched diagonally between the midpoints of its adjacent edges whether intended for winter use, or for other seasonal use, with less quantity of down or synthetic material. In this embodiment, and when intended for winter use, four-large diamond-shaped sections result, producing five connecting interstices. In a second embodiment, intended for spring and fall use where less down or synthetic material is employed, the comforters of the invention are additionally stitched from one edge to its opposing edge, and in a manner to intersect the five connecting interstices thereby dividing the four-diamond-shaped sections essentially in half. In a third embodiment, intended for summer use where even less down or synthetic material is employed, the comforters are further stitched between its remaining two edges, also to intersect the five connecting interstices, and dividing in half once again, the original diamond shaped sections. As will be seen from the discussion that follows, by lessening the size of the sections then being filled with less material as one proceeds from winter to summer use in this manner, the degree of "puff" of the comforter can be maintained, as can its luxuriant look. As will also become clear hereinafter, by affixing fabric ties or buttons at the locations of the five interstices, corresponding apertures can be cut into the duvet, or other such, cover being used, and there secured to maintain the comforter correctly in position, without sliding about the cover, during use.

BRIEF DESCRIPTION OF THE DRAWING

These and other features of the present invention will be more clearly understood from a consideration of the two figures of the drawing showing a comforter constructed in accordance with the present invention, and a cover for it, respectively.

DETAILED DESCRIPTION OF THE DRAWING

Figure 1:
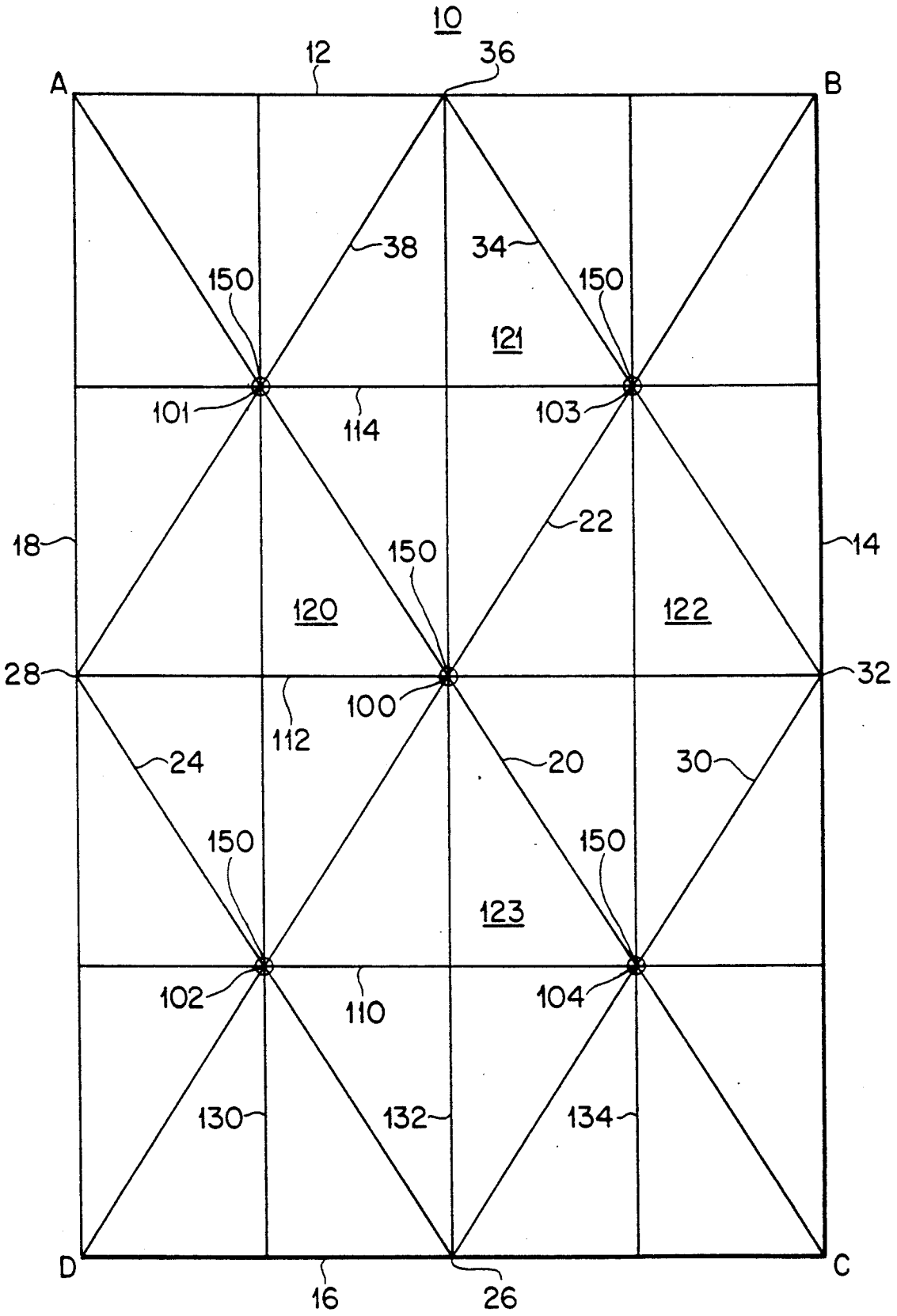

Referring to the drawing, the comforter of the invention 10 is shown as having four orthogonal edges 12, 14, 16, 18 forming four corners A, B, C, D on the front and back sides thereof. As will be understood, the comforter is filled with one of a down or synthetic material, of a quantity depending upon the quality of the fabric employed for the comforter and/or upon the quality of down utilized for a given comforter size—king, queen, twin, etc. (FIG. 1).

In accordance with the invention, the comforter 10 is stitched diagonally between its corners A and C, as at 20 and, also, between its corners B and D, as at 22. Also in accordance with the invention, the comforter 10 is diagonally stitched between the midpoints of its adjacent edges—as at 24, between the midpoint 28 on the edge 18 and the midpoint 26 on the edge 16; also, as at 30, between the midpoint 32 on the edge 14 and the midpoint 26 on the edge 16; additionally, as at 34, between the midpoint 36 on the edge 12 and the midpoint 32 on the edge 14; and, lastly, as at 38, between the midpoint 28 on the edge 18 and the midpoint 36 on the edge 12. As will further be seen, and according to the invention, as a result of these diagonal stitchings, five connecting interstices are formed—one, 100, formed by the intersection of the diagonals from corners A & C and from corners B & D; a second, 101, from the intersections of the stitchings 20 and 38, a further one, 102, at the intersection of the stitchings 22, 24; a further one, 103, at the intersection of the stitchings 22, 34; and a final one, 104, at the intersection of the stitchings 20, 30. As will be seen, four large diamond-shaped sections result, 120, 121, 122, 123. At each of these connecting interstices, a fabric tie, button, etc. 150 is affixed. When the comforter as so far described is to be used for winter use, the down or synthetic material, previously inserted between the front and back sides of the comforter, then fills the area without the diamond-shaped sections, as well as between them and the outer edges of the comforter, 12, 14, 16, 18. When inserted into a duvet or other cover having apertures cut in the area of the connecting interstices 101, 102, 103, 104, the fabric ties, buttons, etc. 150 will be observed to extend through, to be secured to the cover, and thereby holding the cover in position with respect to the comforter, so as to prevent the comforter from sliding about.

In accordance with a second embodiment of the invention, intended for spring and fall use, three additional stitchings are employed, extending from one edge of the comforter to its opposing edge, and so as to intersect the five connecting interstices. Thus, an additional stitching 110 is shown as extending from the edge 18 to intersect the interstices 102 and 104 when connecting with the edge 14. In like manner, an additional stitching 112 extends from the edge 18 (at its midpoint 28) to connect with the midpoint 32 of the edge 14, by intersecting the interstice 100. Further, and as shown, a third stitching 114 extends from the edge 18, through the interstices 101 and 103, to connect with the opposing edge 14. As will be appreciated, such additional stitchings serve to essentially divide each diamond-shaped section 120, 121, 122, 123 in half, horizontally as shown. With there being less down, or other synthetic, material included within the front and back sides of the comforter fabric in such spring and fall use, the smaller section size that results will be seen to maintain an equal look of "puff" as is exhibited by heavy-weight comforter, where the diamond-shaped sections 120, 121, 122 and 123 are not bisected in this manner.

In a third embodiment of the invention, for use where the comforter is to be light-weight, as in summertime, the comforter 10 is further stitched between its remaining two edges 12, 16, also so as to intersect the five connecting interstices 100, 101, 102, 103 and 104. Thus, a further stitching 130 is shown, extending between the comforter edges 12 and 16, passing through the interstices 101, 102. Similarly, a second like stitching 132 couples between the midpoint 36 on the edge 12 and the midpoint 26 on the edge 16, passing through the interstice 100. Lastly in this third of three stitchings similar to the ones 110, 112, 114 is the stitching 134, extending between the comforter edges 12 and 16, so as to intersect the interstices 103 and 104. One obvious result is to note that the original diamond-shaped sections 120, 121, 122, 123 are divided in half once more, so as to form segments of equal size with all those segments surrounding the original diamond-shaped sections 120, 121, 122, 123. As will be thus appreciated, the lesser amount of down, or synthetic, material weight needed for such light-weight use is met with correspondingly smaller areas of material, to maintain the look of "puff" and "luxuriance" as was existent with the heavy-weight or mid-weight comforter.

Various benefits will be seen to follow from the embodiments described above. First, and as just described, the pattern of stitching will be seen to be such that when less quantity of filler material is to be added—and, because of the "weight"-characteristic desired—the amount of space filled by that material is made correspondingly less, so as to maintain the look of "puff" which is so attractive. Secondly, no matter what the weight of the down, or synthetic, material might be, or how much material is added, the location of the fabric ties, buttons, etc. 150 continue to remain at the same location on the comforter. What this means, as will be evident, is that the same duvet, or other, cover can be employed for all-weight comforters, once the apertures in the cover are cut so as to allow the fabric ties, buttons, etc. 150 to extend there through. In other words, for all sake of appearance, the cover and comforter will continue to look the same, no matter what weight of comforter is employed, and no matter what season of use. Although—and as will be appreciated—applicant's embodiments will work no matter what type of fabric is employed for the comforter, and no matter what composition the filler material might be, particularly desirable results have been obtained using cotton fabric of a 200–350 thread count, and with a "down" filler. For a given comforter size, it will then be appreciated that the quality of "down" and the "thread count" employed can be selected in determining the price-range to be charged for comforters and cover combinations then to be sold. As will be appreciated, however, the comforter will continue to be held in place within the cover, and the only thing that would be detectable would be the difference in weight as the comforter inside is changed from season-to-season use.

Figure 2:
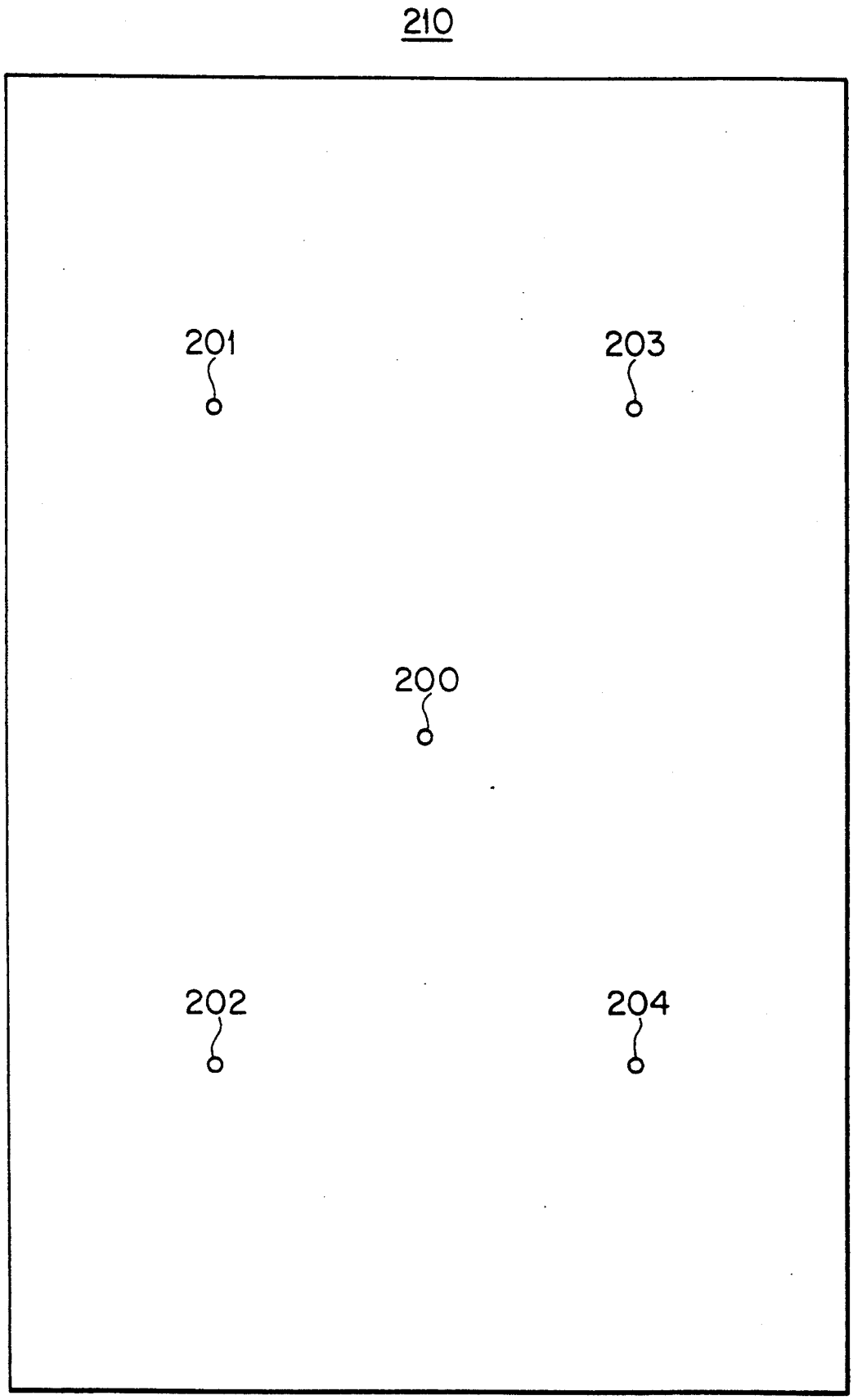

Such a cover, as applicable with the invention is shown at 210, with the apertures to receive the fabric ties, buttons, etc. being shown as 200, 201, 202, 203 and 204 in FIG. 2.

While there have been described what are considered to be preferred embodiments of the present invention, it will be readily understood by those skilled in the art that modifications can be made without departing from the scope of the teachings herein. Thus, whereas the present invention has been described in the context of using a cotton fabric for the comforter with a high-quality down filler, other materials can be employed without departing from the scope of the teachings of, first, lessening the size of the sections being filled with less material as one proceeds from winter to summer use, and second, maintaining constant locations of the five connecting interstices to facilitate the securing of the comforter to its cover. For at least such reasons, therefore, resort should be had to the claims appended hereto for a true understanding of the scope of the invention.

I claim:

1. A fabric comforter set adapted for year-around use comprising at least two comforters of differing weights selected from the group consisting of light-weight, mid-weight and heavy-weight comforters, and a cover, said cover being interchangeable with said comforters, each of said comforters comprising rectangular-shaped front and back sides joined together at corresponding top and bottom edges and right and left side edges to form a closed interior portion, said interior portion being further divided into closed pockets by stitching, said stitching of said heavy-weight comforter comprising:

a first stitching extending from a top left corner to a bottom right corner, a second stitching extending from a top right corner to a bottom left corner, a third stitching extending from a midpoint of the top edge to the midpoint of the right side edge, a fourth stitching extending from the midpoint of the top edge to the midpoint of the left side edge, a fifth stitching extending from the midpoint of the bottom edge to the midpoint of the right side edge, and a sixth stitching extending from the midpoint of the bottom edge to the midpoint of the left side edge, whereby five connecting interstices are formed;

said stitching of said mid-weight comforter comprising said heavy-weight comforter stitching and three additional stitchings comprising seventh, eighth and ninth stitchings, each extending from said left side edge to said right side edge and parallel to said top and bottom edges, said seventh stitching intersection interstices formed by said first and fourth stitchings and by said second and third stitchings, said eighth stitching intersecting an interstice formed by said first and second stitching, and said ninth stitching intersecting interstices formed by said second and sixth stitchings and by said first and fifth stitchings, said stitching of said light-weight comforter comprising said mid-weight comforter stitching and three additional stitchings comprising tenth, eleventh and twelfth stitchings, each extending from said top edge to said bottom edge and parallel to said left and right side edges, said tenth stitching intersecting interstices formed by said first and fourth stitchings and by said second and sixth stitchings, said eleventh stitching intersecting an interstice formed by said first and second stitching, and said twelfth stitching intersecting interstices formed by said second and third stitchings and by said first and fifth stitchings;

each of said comforters further comprising a filler material contained in said closed pockets, said filler material being substantially evenly distributed throughout the interior portion of said comforter, said heavy-weight comforter comprising more of said filler material than said mid-weight comforter, said mid-weight comforter comprising more of said filler material than said light-weight comforter; and fastening means attached at each of said five interstices;

said cover comprising coupling means in positions corresponding to said fastening means and for attachment thereto, whereby one of said comforters is held in position inside said cover.

2. The fabric comforter set according to claim 1 wherein said fastening means is selected from the group consisting of fabric ties and buttons.

3. The fabric comforter set according to claim 1 wherein at least one of said comforters is constructed of a cotton fabric.

4. The fabric comforter set according to claim 1 wherein at least one of said comforters is constructed of a fabric having a 200–350 thread count.

5. The fabric comforter set according to claim 1 wherein at least one of said comforters contains a filler material comprising down.

* * * * *